US012534869B2

(12) United States Patent
Ogawa et al.

(10) Patent No.: US 12,534,869 B2
(45) Date of Patent: Jan. 27, 2026

(54) CONSTRUCTION MACHINE

(71) Applicant: HITACHI CONSTRUCTION MACHINERY CO., LTD., Tokyo (JP)

(72) Inventors: Daiki Ogawa, Tsuchiura (JP); Shunsuke Asahi, Kasumigaura (JP); Hiromitsu Kaniwa, Saitama (JP); Takuto Sasaki, Kasumigaura (JP); Tsukuru Tendo, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 399 days.

(21) Appl. No.: 18/025,458

(22) PCT Filed: Feb. 10, 2022

(86) PCT No.: PCT/JP2022/005331
§ 371 (c)(1),
(2) Date: Mar. 9, 2023

(87) PCT Pub. No.: WO2022/209339
PCT Pub. Date: Oct. 6, 2022

(65) Prior Publication Data

US 2023/0332372 A1 Oct. 19, 2023

(30) Foreign Application Priority Data

Mar. 31, 2021 (JP) ..... 2021-061496

(51) Int. Cl.
*E02F 3/30* (2006.01)
*E02F 3/42* (2006.01)
(Continued)

(52) U.S. Cl.
CPC ..... *E02F 3/301* (2013.01); *E02F 3/302* (2013.01); *E02F 3/425* (2013.01); *E02F 9/2271* (2013.01); *E02F 9/24* (2013.01)

(58) Field of Classification Search
None
See application file for complete search history.

(56) References Cited

U.S. PATENT DOCUMENTS 7,958,980 B2 * 6/2011 Seino ..... E02F 9/24 74/615
10,392,783 B2 * 8/2019 Nishide ..... F15B 15/1423

FOREIGN PATENT DOCUMENTS

JP 54-180372 U 12/1979
JP 04-133518 U 12/1992
(Continued)

OTHER PUBLICATIONS

International Search Report of PCT/JP2022/005331 dated Apr. 26, 2022.
(Continued)

*Primary Examiner* — Michael S Lowe
(74) *Attorney, Agent, or Firm* — MATTINGLY & MALUR, PC

(57) ABSTRACT

A working mechanism (8) includes a lower boom (9), an upper boom (10), a middle arm (11), an arm (12), a working tool (13), a working tool cylinder (22), and a link (16). The working tool cylinder (22) is disposed on a lower surface (12B) side of the arm (12), and a cylinder guard (23) is fixed on a first link (17) of the link (16). The cylinder guard (23) is rotationally displaced in synchronization with an expanding or contracting operation of the working tool cylinder (22) and is interposed between the working tool (13) and the working tool cylinder (22) to protect the working tool cylinder (22).

2 Claims, 8 Drawing Sheets

(51) Int. Cl.
*E02F 9/22* (2006.01)
*E02F 9/24* (2006.01)

(56) References Cited

FOREIGN PATENT DOCUMENTS

| | | | |
|---|---|---|---|
| JP | 3000513 | U | 8/1994 |
| JP | 08-296611 | A | 11/1996 |
| JP | 2004183421 | A | 7/2004 |
| JP | 2004190330 | A | 7/2004 |
| JP | 2013104275 | A | 5/2013 |
| JP | 2014015780 | A | 1/2014 |
| KR | 1020110059979 | A | 6/2011 |

OTHER PUBLICATIONS

Korean Office Action received in corresponding Korean Application No. 10-2023-7008132 dated Aug. 28, 2024.
Extended European Search Report received in corresponding European Application No. 22779568.9 dated Sep. 10, 2024.

* cited by examiner

CONSTRUCTION MACHINE

TECHNICAL FIELD

The present disclosure relates to a construction machine with a working mechanism operated by a hydraulic cylinder.

BACKGROUND ART

A vehicle body of a hydraulic excavator is configured, as a typical construction machine, to include a self-propelled lower traveling structure and an upper revolving structure mounted rotatably on the lower traveling structure. A working mechanism is provided on a front side of the upper revolving structure. Specifically, a working mechanism for demolition work is mounted on a front side of an upper revolving structure in order to demolish structures having a large ground height such as high-rise buildings.

A working mechanism for demolition work is normally configured to include a boom whose base end is connected rotatably to a revolving frame of an upper revolving structure and an arm connected rotatably to a tip end of the boom, and a working tool (working attachment) such as a crusher connected rotatably at a tip end of the arm. A boom cylinder lifting the boom is provided between the revolving frame and the boom. An arm cylinder rotating the arm on the tip end side of the boom is provided between the boom and the arm. A working tool cylinder rotating the working tool on the tip end side of the arm (attachment cylinder) is provided between the arm and the working tool, and the working tool cylinder is normally disposed on an upper surface side of the arm.

With a small movable range of working tools relative to an arm in demolition working sites for high-rise buildings or roofed working sites, working tools are often operated below an upper surface of the arm. This restriction commonly renders maximum the ground height of a working tool cylinder disposed on the upper surface side of the arm, resulting in possible interference of the working tool cylinder with ceilings, reinforcing bars and other parts of a building to be demolished.

On the other hand, there has conventionally been proposed a cylinder guard, including a tube-side guard whose one end is mounted on a tube side of a working tool cylinder and a rod-side guard whose one end is mounted on a rod side of the working tool cylinder, in which the other end side of the tube-side guard and the other end side of the rod-side guard are connected movably. The cylinder guard is provided with a guide on the other end side of the tube-side guard to allow the guide to slidably support the other end side of the rod-side guard. This configuration allows the tube-side guard and the rod-side guard to cover the working tool cylinder from above throughout the entire stroke of the working tool cylinder (Patent Document 1).

PRIOR ART DOCUMENT

Patent Document

Patent Document 1: Japanese Patent Laid-Open No. 2014-015780 A

SUMMARY OF THE INVENTION

However, in the cylinder guard according to Patent Document 1, an expanding or contracting operation of a working tool cylinder allows a rod-side guard to slide relative to a guide of a tube-side guard. Thus, fragments including reinforcing bars and concrete of a building generated by demolition work bite into a sliding portion between the rod-side guard and the tube-side guard, which unfortunately hampers smooth slide motion of the rod-side guard. Another problem is its basic configuration that requires not only two guards of a tube-side guard and a rod-side guard, but also mounting tools including bolts and pins for mounting these guards on the tube and rod. Accordingly, a cylinder guard according to Patent Document 1 has drawbacks of increased numbers of parts and mounting operations and rising costs for manufacturing cylinder guards.

It is an object of the present invention to provide a construction machine capable of protecting a working tool cylinder.

The present invention provides a construction machine including a self-propelled vehicle body and a working mechanism provided on the vehicle body, the working mechanism including: a boom mounted rotatably on the vehicle body; an arm mounted rotatably at a tip end of the boom; a working tool mounted rotatably at a tip end of the arm; a working tool cylinder whose one end is mounted on the arm to rotate the working tool; and a link mounted rotatably on the tip end side of the arm and connecting the other end of the working tool cylinder and the working tool, in which the working tool cylinder is disposed on a lower surface side of the arm that faces the boom when the arm is folded on the boom side, and the link is provided with a cylinder guard that is rotationally displaced in synchronization with an expanding or contracting operation of the working tool cylinder and is interposed between the working tool and the working tool cylinder.

According to the present invention, a cylinder guard is rotationally displaced in synchronization with an expanding or contracting operation of a working tool cylinder and is interposed between a working tool and a working tool cylinder while moving together with a link. Consequently, the cylinder guard can prevent fragments scattered from a building from hitting the working tool cylinder to protect the working tool cylinder when the building is demolished using working tools, for example.

MODE FOR CARRYING OUT THE INVENTION

Figure 1:
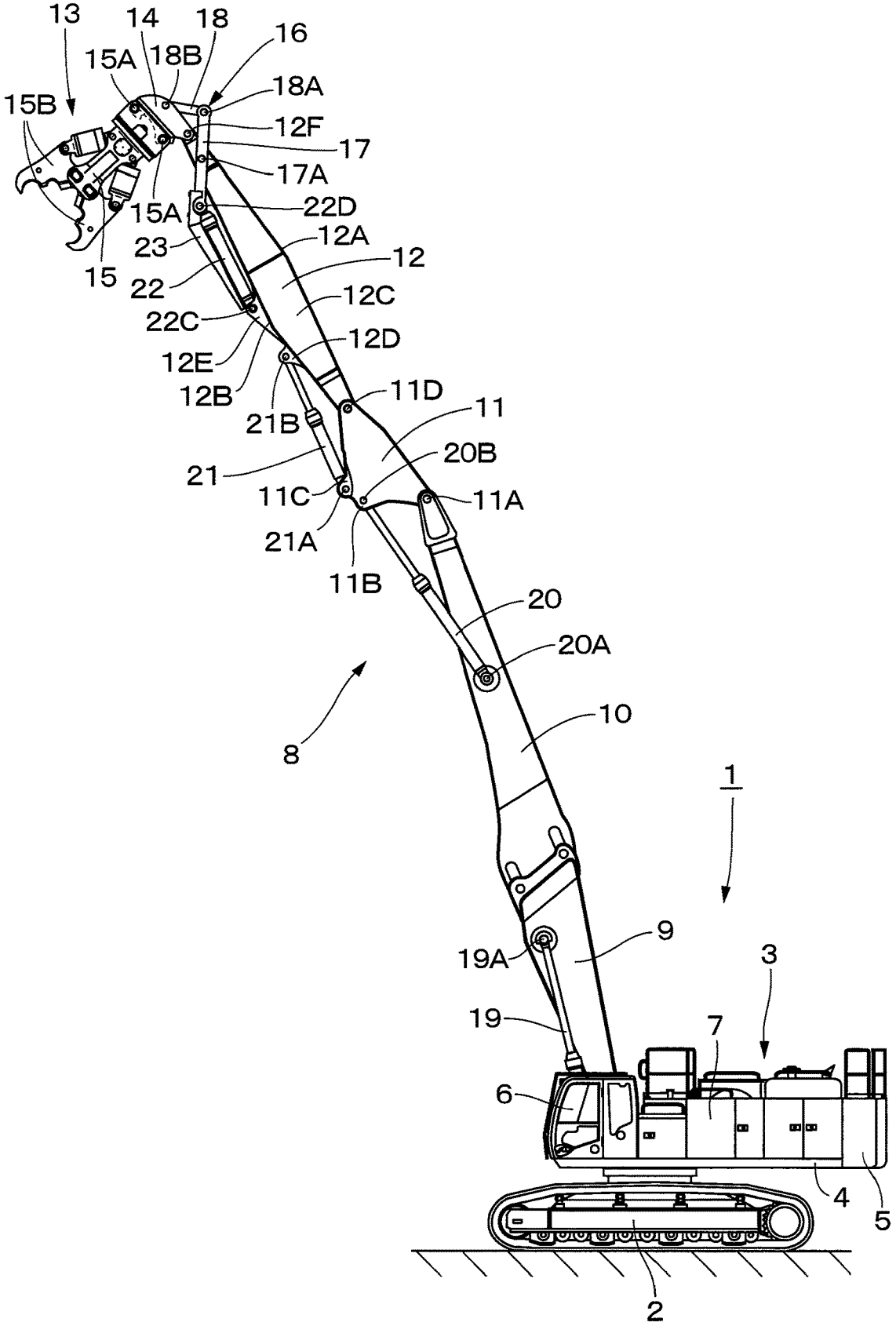
FIG. 1 is a left side view of a hydraulic excavator for demolition work according to an embodiment of the present invention.

Hereinafter, an embodiment of a construction machine of the present invention will be described in detail with reference to the attached drawings by way of the cases applied to hydraulic excavators for demolition work as an example. In this embodiment, the running direction of a hydraulic excavator is defined as front-and-rear direction, and the direction perpendicular to the running direction is defined as right-and-left direction.

A hydraulic excavator 1 for demolition work is configured to include a self-propelled crawler type lower traveling structure 2, an upper revolving structure 3 mounted rotatably on the lower traveling structure 2, and a working mechanism 8 provided on a front side of the upper revolving structure 3. The lower traveling structure 2 and the upper revolving structure 3 constitute a vehicle body of the hydraulic excavator 1. The hydraulic excavator 1 is suitably used for demolition work for structures having a large ground height such as high-rise buildings.

The upper revolving structure 3 is configured to include a revolving frame 4 that is to be a base, a counterweight 5 provided on a rear end side of the revolving frame 4, a cab 6 disposed on a front left side of the revolving frame 4, and a housing cover 7 disposed on a front side of the counterweight 5. The cab 6 defines an operator's room for an operator to steer the hydraulic excavator 1, the cab 6 being provided with a traveling lever and pedal device controlling the traveling operation of the lower traveling structure 2 and a control lever device controlling the revolving operation of the upper revolving structure 3 and the operation of the working mechanism 8 (each not shown). Onboard equipment (not shown), including an engine, a hydraulic pump, and a heat exchanger, is accommodated inside the housing cover 7.

A support bracket (not shown) of mountain shape rising up from a bottom plate is integrally provided at a front end of the revolving frame 4. The support bracket rotatably supports a base end side of a later-described lower boom 9 and rotatably supports a base end side of a boom cylinder 19.

The multi-boom type working mechanism 8 is mounted at a front end portion of the revolving frame 4 that constitutes the upper revolving structure 3. The working mechanism 8 is configured to include a lower boom 9 and an upper boom 10 that constitute a boom, a middle arm 11 and an arm 12 that constitute an arm, a working tool 13, and a link 16.

The base end side of the lower boom 9 is mounted rotatably on the front end side of the revolving frame 4 (the support bracket). A base end side of the upper boom 10 is fixed on a tip end of the lower boom 9 with a fastener such as a bolt. A base end side of the middle arm 11 is connected rotatably to a tip end of the upper boom 10 with a pin 11A. The middle arm 11 is provided with a first bracket 11B and a second bracket 11C, which are adjacent to each other. A base end side of the arm 12 is connected rotatably to a tip end of the middle arm 11 with a pin 11D.

Figure 10:
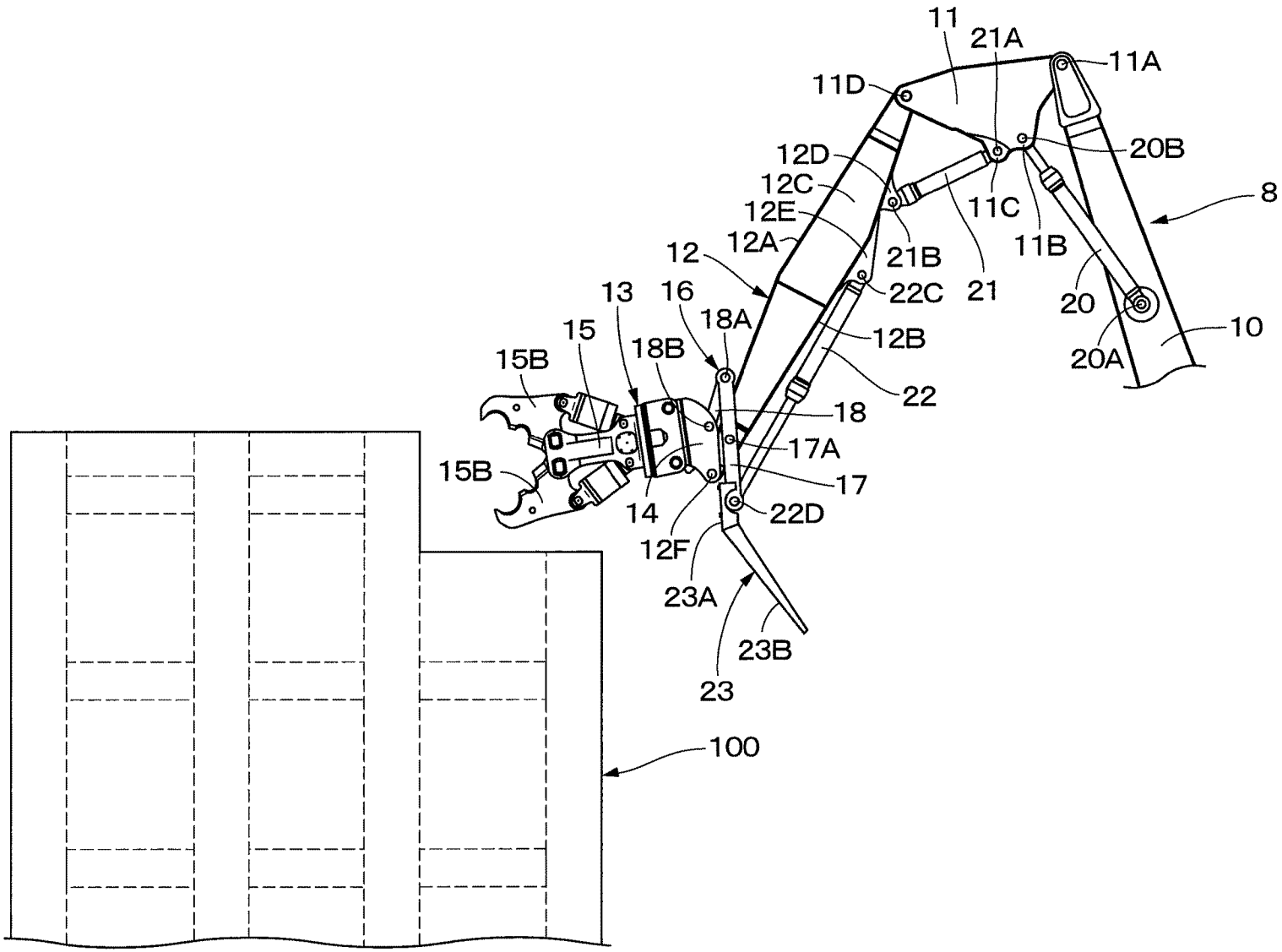
FIG. 10 is a left side view of the working mechanism performing demolition work, with the working tool cylinder in the extended state.

The arm 12 is formed as an angular tubular body of cross-sectionally rectangular shape surrounded by an upper surface 12A, a lower surface 12B, and right and left side surfaces 12C. As shown in FIG. 10, the lower surface 12B of the arm 12 faces the upper boom 10 when the arm 12 is folded on the upper boom 10 side. The lower surface 12B of the arm 12 is provided with a first bracket 12D and a second bracket 12E, which are adjacent to each other. A joint device 14 of the working tool 13 is connected rotatably to a tip end of the arm 12 with a pin 12F.

The working tool 13 is mounted rotatably at the tip end of the arm 12. In this embodiment, the working tool 13 is configured by the joint device 14 and a crusher 15.

Figure 2:
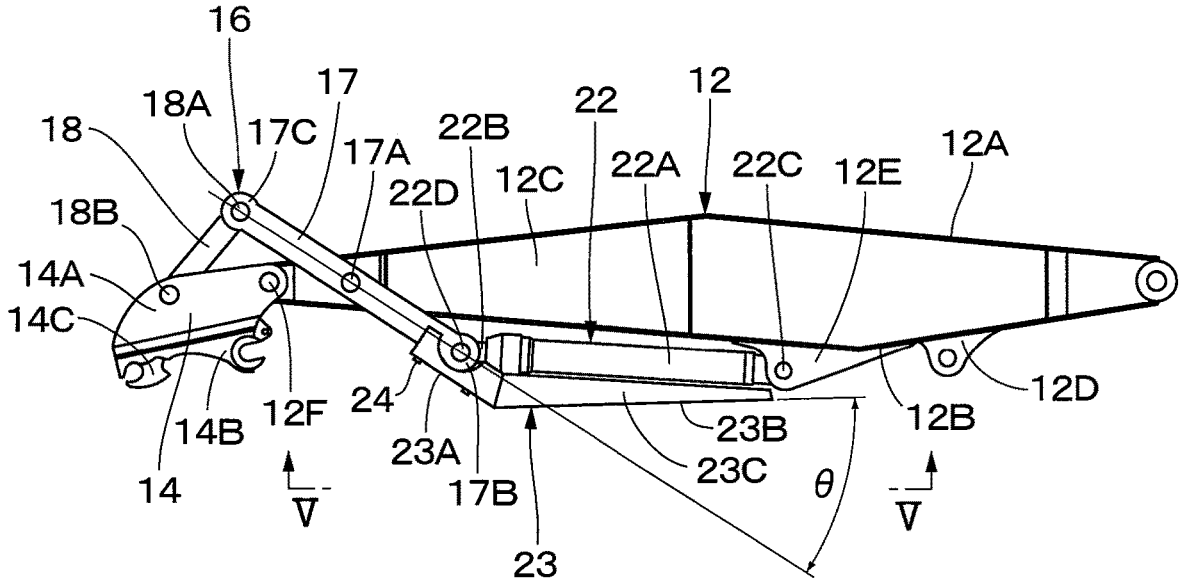
FIG. 2 is a left side view of an arm, a link, and a cylinder guard when a working tool cylinder is in a reduced state.
Figure 3:
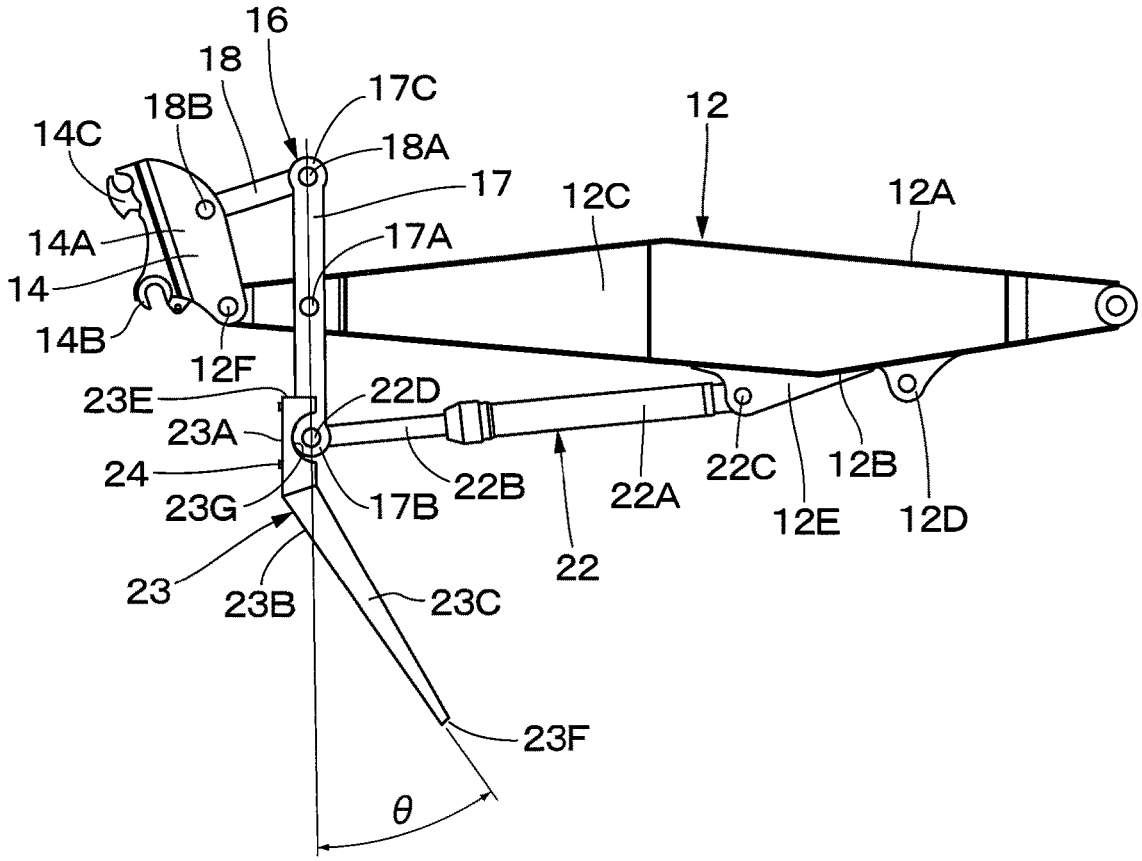
FIG. 3 is a left side view of the arm, the link, and the cylinder guard when the working tool cylinder is between the reduced state and an extended state.
Figure 4:
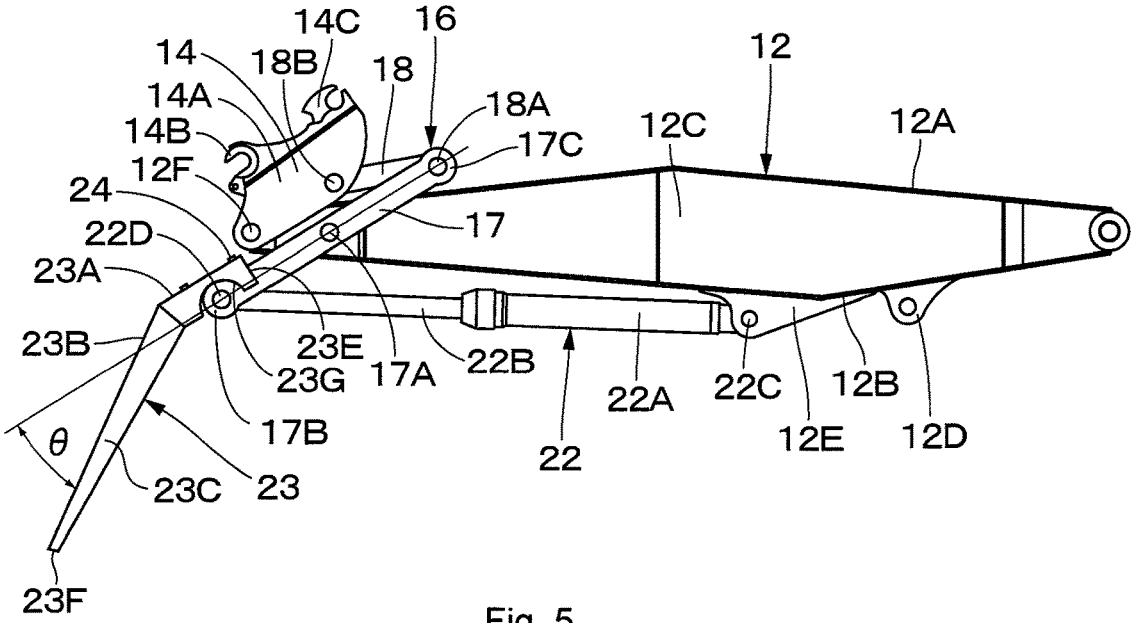
FIG. 4 is a left side view of the arm, the link, and the cylinder guard when the working tool cylinder is in the extended state.

The joint device 14 is a device for mounting a working attachment such as a bucket, a grapple, and the crusher 15 replacing the tip end of the arm 12, depending on the type of operation of the hydraulic excavator 1. In this embodiment, the crusher 15 for demolition work is mounted on the joint device 14, both of which make up the working tool 13. As shown in FIG. 2, the joint device 14 includes a base member 14A, a fixed hook 14B fixed on the base member 14A, and a movable hook 14C. The movable hook 14C is provided movably on the base member 14A to move in a direction approaching or separating from the fixed hook 14B.

The crusher 15 for demolition work is mounted rotatably at the tip end of the arm 12 through the joint device 14. A base end side of the crusher 15 is provided with two pins 15A, whose engagement with the fixed hook 14B and the movable hook 14C of the joint device 14 allows the crusher 15 to be fixed on the joint device 14. The crusher 15 includes right and left paw members 15B that open and close with a hydraulic cylinder to crush a building and collect fragments at nearby stable places to prevent such crushed pieces from falling down.

The link 16 is provided on the tip end side of the arm 12 to connect a later-described working tool cylinder 22 and the working tool 13. As shown in FIGS. 2 to 5, the link 16 is configured by a first link 17 and a second link 18, and rotates in synchronization with an expanding or contracting operation of the working tool cylinder 22 to rotate the working tool 13 relative to the arm 12.

The first link 17 is formed of a pair of link plates linearly extending, which face each other in the right-and-left direction, with the arm 12 disposed therebetween. An intermediate portion in a length direction of the first link 17 is connected rotatably to a position adjacent to a connecting portion (pin 12F) with the joint device 14 on the tip end side of the arm 12 through a pin 17A. One end 17B in the length direction of the first link 17 is disposed on the lower surface 12B side of the arm 12 and connected to a rod 22B of the working tool cylinder 22. The other end 17C in the length direction of the first link 17 is disposed on the upper surface 12A side of the arm 12 and connected to the second link 18. The right and left first links 17 are each provided on one end 17B side with two sheet screws (not shown).

The second link 18 is provided between the other end 17C of the first link 17 and the joint device 14 to connect these two elements. One end in a length direction of the second link 18 is connected rotatably to the other end 17C of the first link 17 through a pin 18A. The other end in the length direction of the second link 18 is connected rotatably at a position separate from the pin 12F on the base member 14A of the joint device 14 with a pin 18B.

A pair of (2) right and left boom cylinders 19 are provided between the revolving frame 4 and the lower boom 9 (only left side shown). A bottom side of the boom cylinder 19 is mounted rotatably on the support bracket of the revolving frame 4. A rod side of the boom cylinder 19 is connected rotatably on the tip end side of the lower boom 9 with a pin 19A. A pair of (2) right and left middle arm cylinders 20 are provided between the upper boom 10 and the middle arm 11 (only left side shown). A bottom side of the middle arm cylinder 20 is connected rotatably to the upper boom 10 with a pin 20A, and a rod side of the middle arm cylinder 20 is connected rotatably to the first bracket 11B of the middle arm 11 with a pin 20B. An arm cylinder 21 is provided between the middle arm 11 and the arm 12. A bottom side of the arm cylinder 21 is connected rotatably to the second bracket 11C of the middle arm 11 with a pin 21A, and a rod side of the arm cylinder 21 is connected rotatably to the first bracket 12D of the arm 12 with a pin 21B.

The working tool cylinder 22 is disposed on the lower surface 12B side of the arm 12 and provided between the arm 12 and the link 16. The working tool cylinder 22 includes a tube 22A, a piston (not shown) provided slidably within the tube 22A, and the rod 22B whose base end is mounted on the piston and whose tip end side projects from the tube 22A. One end (tube 22A) in a length direction of the working tool cylinder 22 is connected rotatably to the second bracket 12E of the arm 12 with a pin 22C. The other end (rod 22B) in the length direction of the working tool cylinder 22 is connected rotatably to the one end 17B of the first link 17 with a pin 22D.

Therefore, the working tool cylinder 22 performs an expanding or contracting operation to allow the first link 17 to rotate about a connecting portion (pin 17A) with the arm 12 and the resulting motion of the first link 17 is transmitted to the joint device 14 through the second link 18. As a result, the working tool 13 composed of the joint device 14 and the crusher 15 rotates about a connecting portion (pin 12F) with the arm 12. In this embodiment, the working tool cylinder 22 expands or contracts between a reduced state and an extended state to allow the crusher 15 to be rotationally displaced in the ranges shown in FIG. 8 to FIG. 10 and perform demolition work of a building.

In this case, the working tool cylinder 22 is disposed on the lower surface 12B side of the arm 12, which thus allows the working tool cylinder 22 to be in an extension motion to rotate the working tool 13 upward about the pin 12F. Meanwhile, the working tool cylinder 22 is in a reduction motion to rotate the working tool 13 downward. Therefore, as compared with cases where the working tool cylinder 22 is disposed on the upper surface 12A side of the arm 12, the working tool cylinder 22 is in the extension motion to successfully generate large forces to raise waste materials including reinforcing bars and concrete generated in demolition work using the working tool 13.

Subsequently, a cylinder guard 23 used in this embodiment will be described with reference to FIG. 2 to FIG. 6. The cylinder guard 23 is fixed on the pair of first links 17 that constitute the link 16. The cylinder guard 23 is interposed between the working tool 13 and the working tool cylinder 22 to protect the working tool cylinder 22 when the working tool cylinder 22 expands or contracts between the reduced state (the state shown in FIG. 2) and the extended state (the state shown in FIG. 4).

Figure 5:
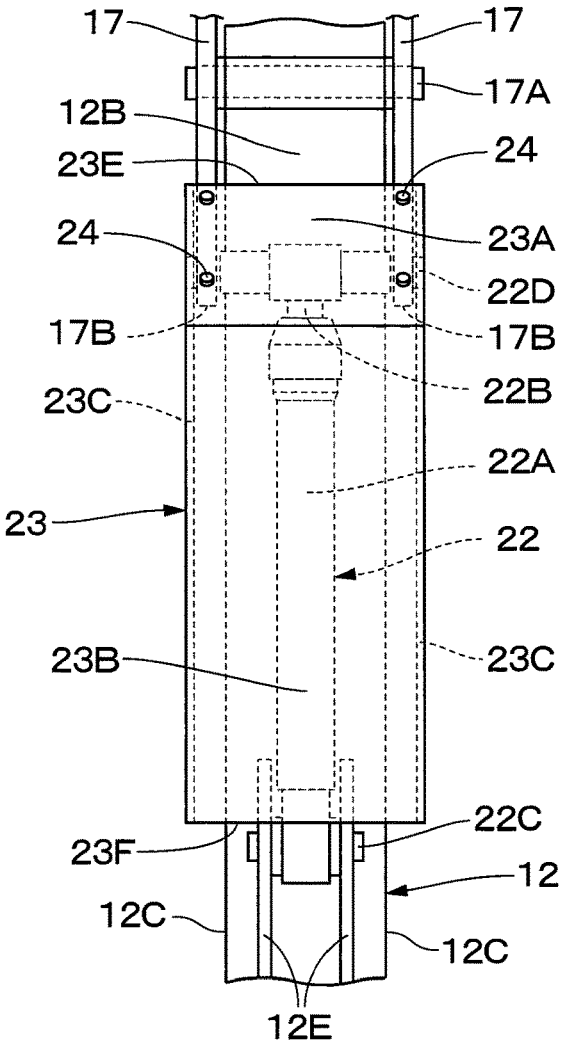
FIG. 5 is an elevation view of the arm, the link, the working tool cylinder, and the cylinder guard, viewed along arrows V-V in FIG. 2.
Figure 6:
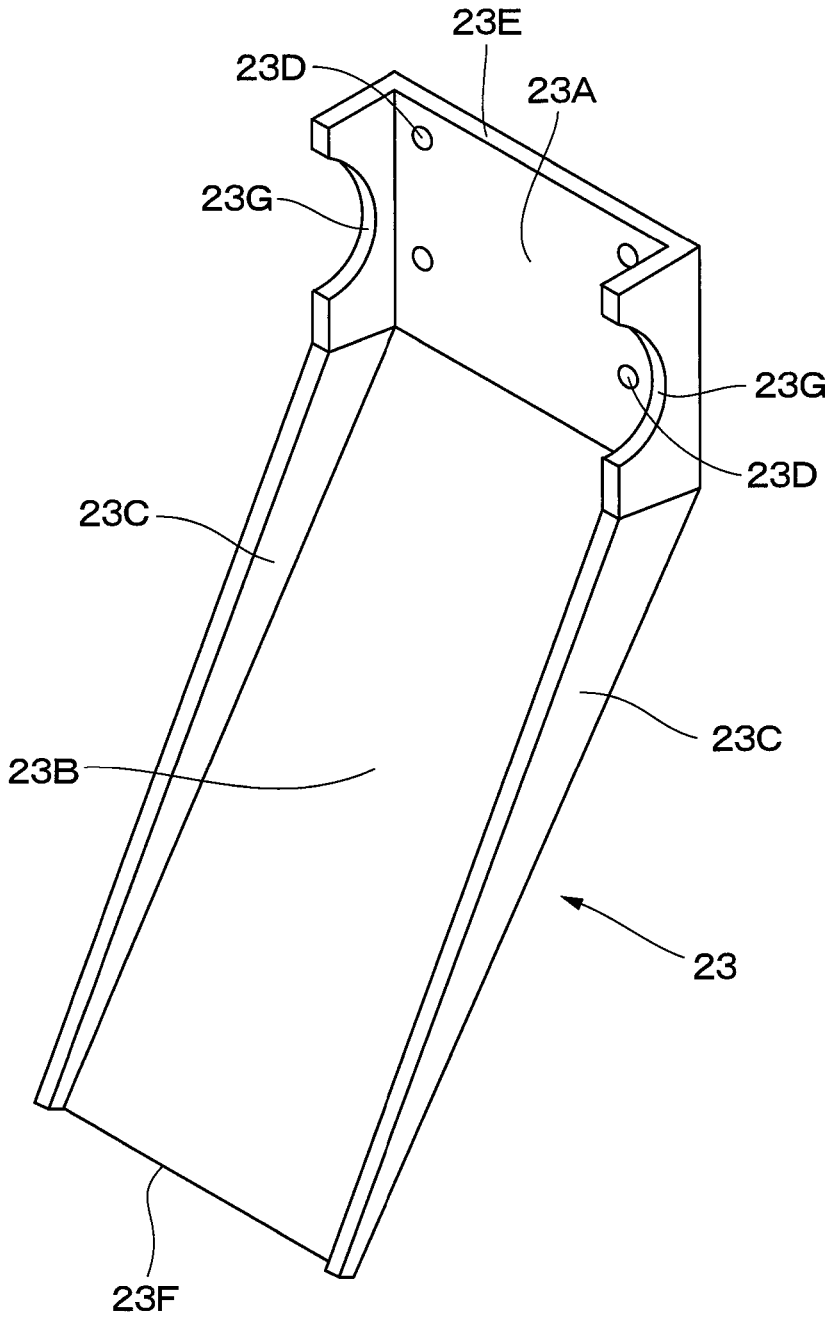
FIG. 6 is a perspective view of the cylinder guard as a single unit.

As shown in FIG. 6, the cylinder guard 23 is formed of a rectangular plate such as a steel plate. The cylinder guard 23 includes a mounting plate portion 23A mounted on the pair of first links 17 and a guard plate portion 23B provided integrally at the mounting plate portion 23A and inclined relative thereto. The guard plate portion 23B has a set tilting angle to the mounting plate portion 23A such that the working tool cylinder 22 is the closest to the working tool cylinder 22 in the reduced state shown in FIG. 2. As shown in FIG. 2 and FIG. 5, the cylinder guard 23 has a length dimension covering the working tool cylinder 22 in the reduced state over the entire length. In addition, a width dimension of the cylinder guard 23 is set slightly larger than the interval of the pair of first links 17, and either end side of the cylinder guard 23 in a width direction is provided with a bending portion 23C. The bending portion 23C is folded at right angles relative to the mounting plate portion 23A and the guard plate portion 23B to increase the entire strength of the cylinder guard 23.

The mounting plate portion 23A of the cylinder guard 23 is provided with a plurality of (e.g., four) bolt through holes 23D. The bolt through holes 23D correspond to two sheet screws (not shown) provided for each of the pair of first links 17 that constitute the link 16. Therefore, a bolt 24 inserted into each of the bolt through holes 23D is screwed into a sheet screw of each of the pair of first links 17 to fix the cylinder guard 23 on the first links 17. Accordingly, the cylinder guard 23 has one end 23E in a length direction thereof, which is fixed on the first link 17, and the other end 23F in the length direction, which is a free end. The angle θ formed by the guard plate portion 23B of the cylinder guard 23 and the first link 17 is constant regardless of an expanding or contracting operation of the working tool cylinder 22.

In addition, a semicircular notched portion 23G is formed at each position on the axis of the pin 22D connecting the working tool cylinder 22 and the first link 17, the position being at the bending portion 23C provided on both end sides in a width direction of the mounting plate portion 23A. The notched portion 23G prevents interference of both ends of the pin 22D with the bending portion 23C when the cylinder guard 23 is mounted on the first link 17.

Figure 7:
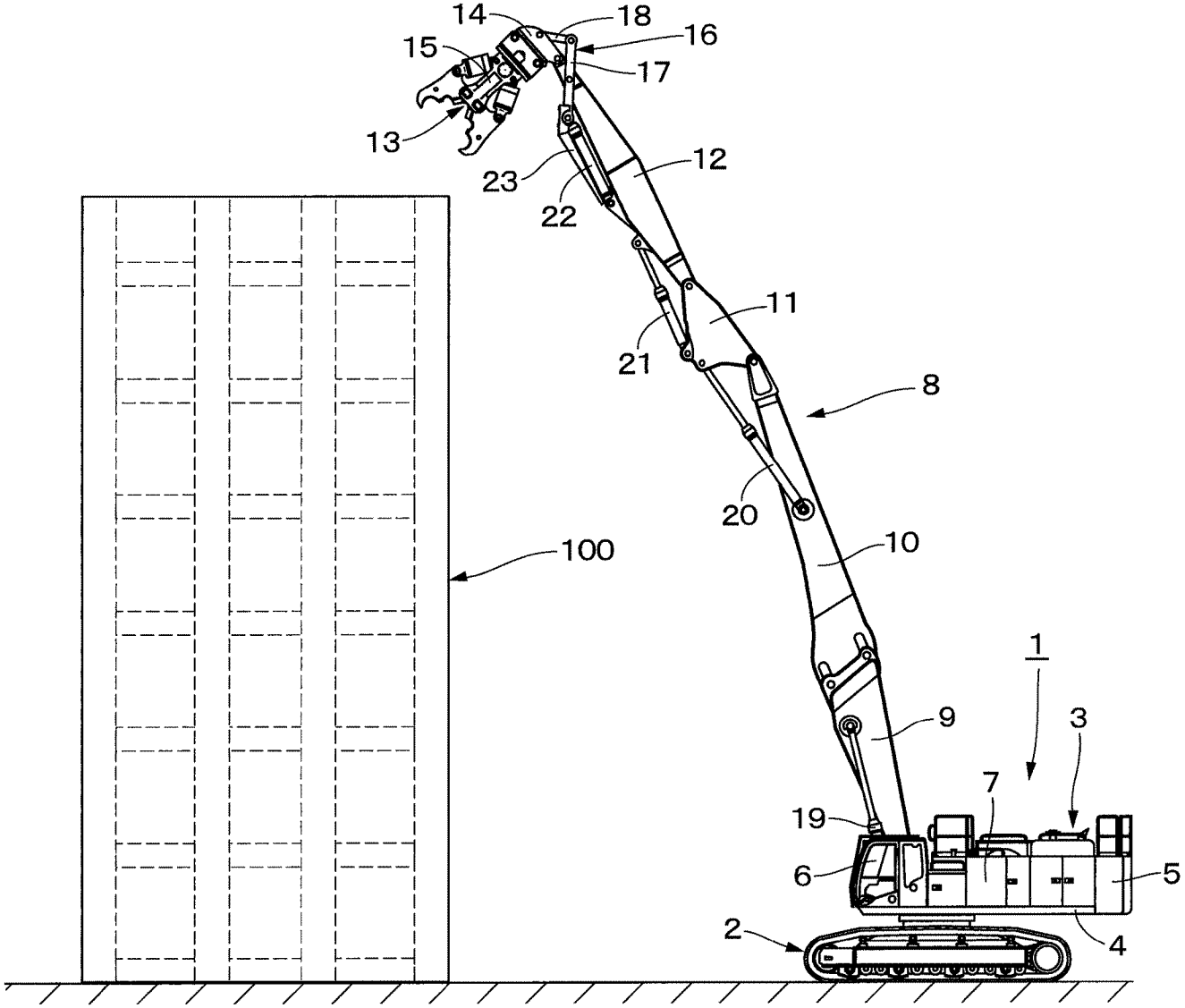
FIG. 7 is a left side view of a state where the hydraulic excavator performs demolition work of a building.

The hydraulic excavator 1 of this embodiment is configured as described, and as shown in FIG. 7, for example, the hydraulic excavator 1 is self-propelled by the lower traveling structure 2 to approach a building 100 to be demolished. Then, the boom cylinder 19, the middle arm cylinder 20, and the arm cylinder 21 of the working mechanism 8 are each in the extended state, while the lower boom 9, the upper boom 10, the middle arm 11, and the arm 12 are allowed to rise linearly. As a result, the working tool 13 comes at a high place to allow the hydraulic excavator 1 to cause the crusher 15 to demolish the building 100 and to discard waste materials including reinforcing bars and concrete onto a loading platform of a transport vehicle (not shown).

Figure 8:
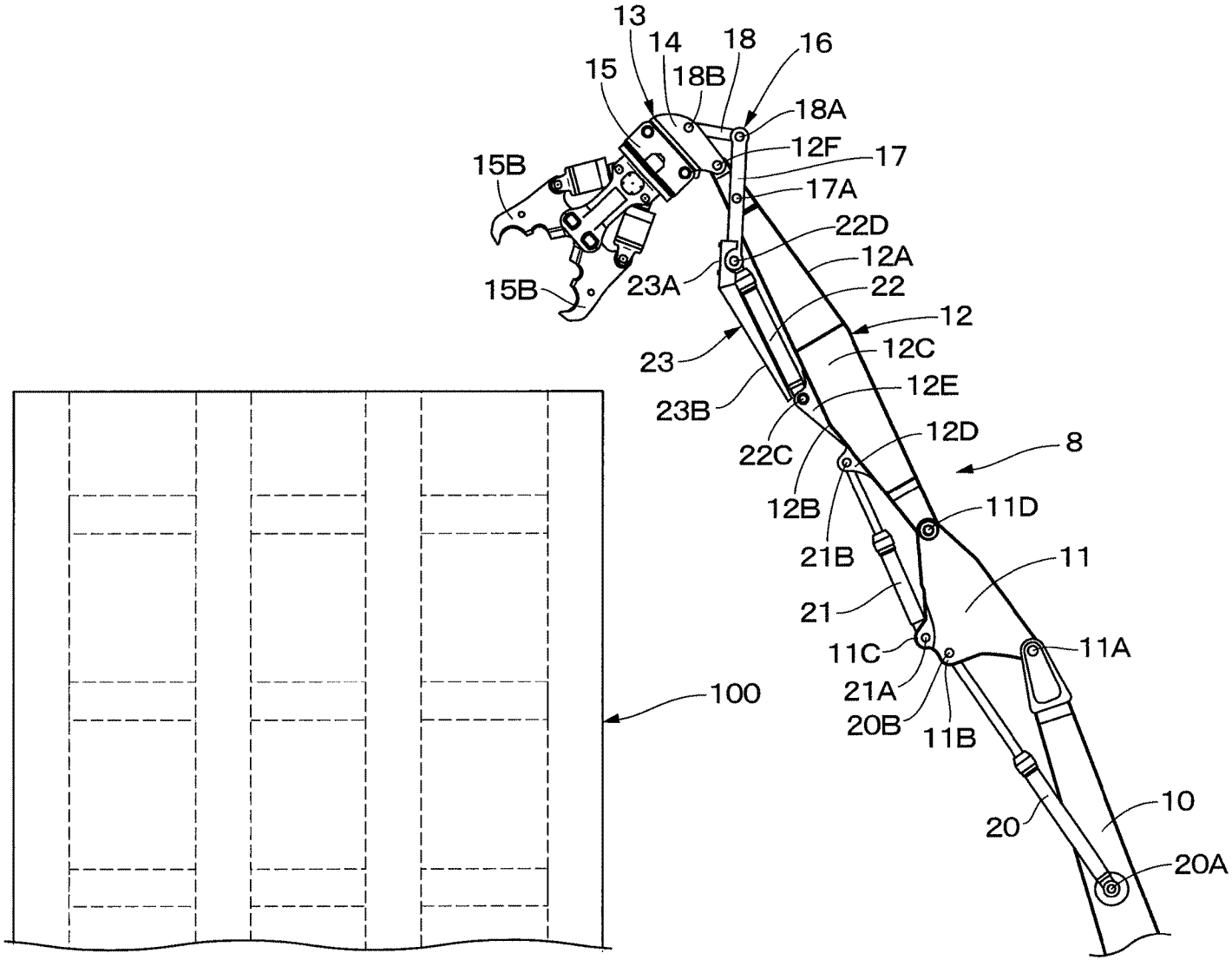
FIG. 8 is a left side view of a working mechanism performing demolition work, with the working tool cylinder in the reduced state.

Herein, when the working mechanism 8 is allowed to rise linearly to perform demolition work, as shown in FIG. 8, the working tool cylinder 22 is in the reduced state to rotate the working tool 13 downward about the pin 12F and allow the crusher 15 to demolish the building 100. Accordingly, while the working mechanism 8 is allowed to stand linearly, the working tool 13 (crusher 15) is normally rotated downward around the pin 12F to perform demolition work. It is not a common practice to rotate the working tool 13 downward around the pin 12F to perform demolition work. In this state, the working tool cylinder 22 is close to the building 100. However, the working tool cylinder 22 in the reduced state allows the cylinder guard 23 to cover the entire working tool cylinder 22. Consequently, even if fragments including reinforcing bars and concrete are scattered around the crusher 15 to demolish the building 100 with the crusher 15, the cylinder guard 23 can prevent such pieces from hitting the working tool cylinder 22 to protect the working tool cylinder 22.

Figure 9:
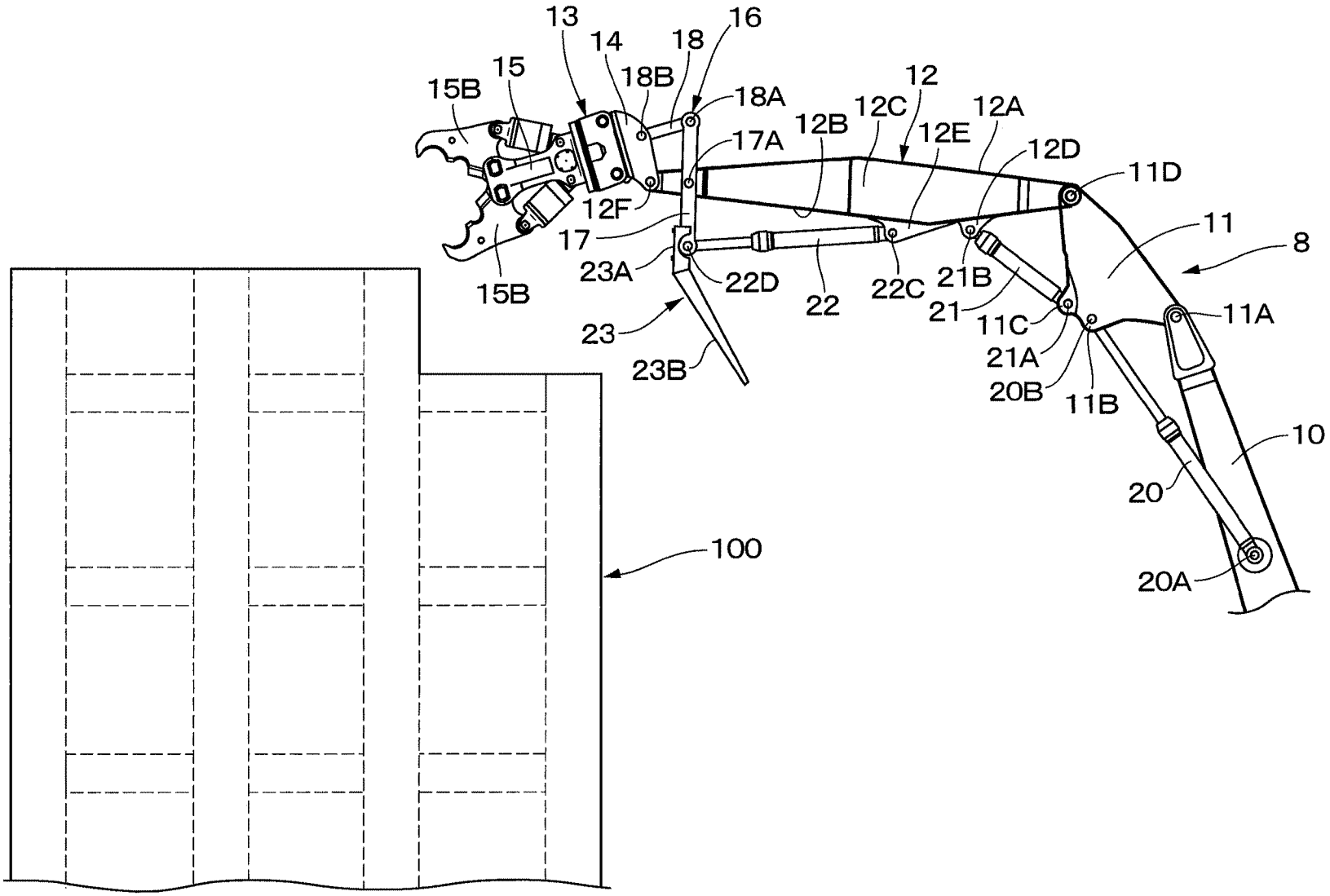
FIG. 9 is a left side view of the working mechanism performing demolition work, with the working tool cylinder between the reduced state and the extended state.

As shown in FIG. 9, when the arm 12 is extended in a horizontal direction from the tip end of the middle arm 11 to perform demolition work, the working tool cylinder 22 is held between the reduced state and the extended state. Then, while the working tool 13 is directly opposed to the building 100, the crusher 15 is allowed to demolish the building 100. Accordingly, it is not a common practice to rotate the working tool 13 downward around the pin 12F to perform demolition work, with the arm 12 extending in the horizontal direction. In this state, the cylinder guard 23 is directly opposed to the building 100 to protect the working tool cylinder 22 from fragments including reinforcing bars and concrete scattered from the building 100.

In addition, as shown in FIG. 10, when the arm 12 is extended downward from the tip end of the middle arm 11 to perform demolition work, the working tool cylinder 22 stays away from the building 100 and the arm 12 is disposed between the building 100 and the working tool cylinder 22. Also, a tip end side of the rod 22B of the working tool cylinder 22 projecting from the tip end of the arm 12 is covered with the cylinder guard 23. In this state, the arm 12 can protect most of the tube 22A and the rod 22B of the working tool cylinder 22 from fragments including reinforcing bars and concrete scattered from the building 100. Meanwhile, the tip end side of the rod 22B of the working tool cylinder 22 can be protected by the cylinder guard 23.

Accordingly, the cylinder guard 23 of this embodiment can constantly be interposed between the working tool 13 and the working tool cylinder 22 to protect the working tool cylinder 22 while the working tool cylinder 22 expands or contracts between the reduced state and the extended state. In this case, the one end 23E side of the cylinder guard 23 is fixed on the first link 17 of the link 16 with the bolt 24, and the cylinder guard 23 is rotationally displaced integrally with the first link 17 to protect the working tool cylinder 22. Thus, the cylinder guard 23 causes no drawback of motion defect due to biting of fragments into a sliding portion, as opposed to a cylinder guard of conventional art in which 2 members of a rod-side guard and a tube-side guard are assembled slidably and displaceably. Therefore, the cylinder guard 23 can assuredly protect the working tool cylinder 22 over extended periods of time.

Moreover, the cylinder guard 23, which is formed of a single part, can readily be mounted on the first link 17 with the bolt 24. Therefore, the cylinder guard 23 is characterized by reduced numbers of parts and mounting operations, as opposed to a cylinder guard of conventional art composed of 2 members of a rod-side guard and a tube-side guard. Therefore, the cylinder guard 23 can contribute to reducing manufacturing costs.

Therefore, in the hydraulic excavator 1 of this embodiment, the working mechanism 8 includes the lower boom 9 and the upper boom 10 mounted rotatably on the upper revolving structure 3, the middle arm 11 and the arm 12 mounted rotatably at the tip end of the upper boom 10, the working tool 13 mounted rotatably at the tip end of the arm 12, the working tool cylinder 22 whose one end is mounted on the arm 12 to rotate the working tool 13, and the link 16 mounted rotatably on the tip end side of the arm 12 and connecting the other end of the working tool cylinder 22 and the working tool 13, in which the working tool cylinder 22 is disposed on the lower surface 12B side of the arm 12 that faces the upper boom 10 when the arm 12 is folded on the upper boom 10 side, and the link 16 is provided with the cylinder guard 23 that is rotationally displaced in synchronization with an expanding or contracting operation of the working tool cylinder 22 and is interposed between the working tool 13 and the working tool cylinder 22.

According to this configuration, the cylinder guard 23 is rotationally displaced in synchronization with the expanding or contracting operation of the working tool cylinder 22 to move together with the link 16, and is interposed between the working tool 13 and the working tool cylinder 22. Consequently, the cylinder guard 23 can prevent fragments scattered from a building from hitting the working tool cylinder 22 to protect the working tool cylinder 22 when the building is demolished using the working tool 13.

In the embodiment, the cylinder guard 23 has a length dimension covering the working tool cylinder 22 in the reduced state over the entire length, formed of a plate provided with the bending portion 23C at both ends in a width direction, and fixed to the first link 17 at a constant angle. This configuration allows no sliding portion to be provided between the cylinder guard 23 and the first link 17. Therefore, no biting of fragments generated by demolition work into the sliding portion occurs to avoid motion defect of the cylinder guard 23. Also, the bending portion 23C can increase the entire strength of the cylinder guard 23.

In the embodiment, the cylinder guard 23 has the one end 23E side in a length direction thereof, which is fixed on the first link 17, and the other end 23F in the length direction, which is a free end. This configuration allows the cylinder guard 23 to be rotationally displaced together with the first link 17, depending on an expanding or contracting operation of the working tool cylinder 22, to protect the working tool cylinder 22.

In fact, the embodiment exemplifies a case where a crusher 15 is mounted at a tip end of an arm 12 through a joint device 14. However, the present invention is not restricted to that, and the crusher 15 may directly be mounted at the tip end of the arm 12.

Also, the embodiment exemplifies a case where an arm 12 is mounted at a tip end of an upper boom 10 through a middle arm 11. However, the present invention is not restricted to that, and the arm 12 may directly be mounted at the tip end of the upper boom 10.

Moreover, the embodiment exemplifies a case where a crusher 15 for demolition work is mounted at a tip end of an arm 12 through a joint device 14. However, the present invention is not limited to that, and may be widely employed in hydraulic excavators including working tools such as a bucket, a grapple, and a lifting magnet.

DESCRIPTION OF REFERENCE NUMERALS

1: Hydraulic excavator (Construction machine)
2: Lower traveling structure (Vehicle body)
3: Upper revolving structure (Vehicle body)
8: Working mechanism
9: Lower boom (boom)
10: Upper boom (boom)
11: Middle arm (arm)
12: Arm
12B: Lower surface
13: Working tool
16: Link
17: First link
18: Second link
22: Working tool cylinder
23: Cylinder guard
23C: Bending portion
23E: One end
23F: The other end

The invention claimed is:

1. A construction machine comprising a self-propelled vehicle body and a working mechanism provided on the vehicle body, the working mechanism comprising:

a boom mounted rotatably on the vehicle body;

an arm mounted rotatably at a tip end of the boom;

a working tool mounted rotatably at a tip end of the arm;

a working tool cylinder whose one end is mounted on the arm to rotate the working tool; and a link mounted rotatably on the tip end side of the arm and connecting the other end of the working tool cylinder and the working tool, wherein the working tool cylinder is disposed on a lower surface side of the arm that faces the boom when the arm is folded on the boom side, and the link is provided with a cylinder guard that is rotationally displaced in synchronization with an expanding or contracting operation of the working tool cylinder and is interposed between the working tool and the working tool cylinder, and the cylinder guard has a length dimension covering the working tool cylinder in a reduced state over an entire length of the working tool cylinder, is formed of a plate provided with a bending portion at both ends in a width direction, and is fixed to the link at a constant angle.

2. The construction machine according to claim 1, wherein the cylinder guard has one end in a length direction thereof, which is fixed on the link, and the other end in the length direction, which is a free end.

* * * * *